United States Patent [19]

Kawai et al.

[11] Patent Number: 4,686,919

[45] Date of Patent: Aug. 18, 1987

[54] METHOD FOR CONSTRUCTING LARGE-SCALE MARINE STRUCTURE

[75] Inventors: Chiaki Kawai, Tokyo; Minoru Ohta; Takahisa Inaba, both of Hisai, all of Japan

[73] Assignee: Nippon Kokan Kabushiki Kaisha, Tokyo, Japan

[21] Appl. No.: 811,839

[22] PCT Filed: Apr. 12, 1985

[86] PCT No.: PCT/JP85/00191

§ 371 Date: Dec. 5, 1985

§ 102(e) Date: Dec. 5, 1985

[87] PCT Pub. No.: WO85/04633

PCT Pub. Date: Oct. 24, 1985

[30] Foreign Application Priority Data

Apr. 14, 1984 [JP] Japan ..... 59-75582

[51] Int. Cl.[4] ..... B63C 1/08

[52] U.S. Cl. ..... 114/45; 114/46; 405/4; 405/5

[58] Field of Search ..... 114/44–48, 114/264, 65 R, 267, 266, 256, 259, 77 R, 77 A, 343, 344, 352; 405/1, 4, 5

[56] References Cited

U.S. PATENT DOCUMENTS

| | | | |
|---|---|---|---|
| 3,656,446 | 4/1972 | Hefferman | 405/4 |
| 3,680,512 | 8/1972 | Yamura | 114/46 |
| 3,976,022 | 8/1976 | Lapeyre | 114/45 |
| 4,056,942 | 11/1977 | Yoshida | 405/4 |
| 4,084,529 | 4/1978 | Katernberg | 405/4 |
| 4,231,679 | 11/1980 | Ivanov | 405/4 |

FOREIGN PATENT DOCUMENTS

| | | | |
|---|---|---|---|
| 47-33873 | 8/1972 | Japan | 405/1 |
| 51-21240 | 7/1976 | Japan | 405/1 |
| 54-77992 | 6/1979 | Japan | 405/1 |
| 56-138085 | 10/1981 | Japan | 405/1 |
| 58-207413 | 12/1983 | Japan | 405/1 |

*Primary Examiner*—Joseph F. Peters, Jr.
*Assistant Examiner*—C. T. Bartz
*Attorney, Agent, or Firm*—Frishauf, Holtz, Goodman & Woodward

[57] ABSTRACT

A method for constructing a large-scale marine structure, which comprises: providing, near a dock (2) of which at least one end faces the waters through a gate (6), a pond (5) having an end thereof facing the waters through another gate (6'); constructing in the dock (2) a plurality of blocks (1A, 1B) for the large-scale marine structure (1); towing out the plurality of blocks (1A, 1B) thus constructed from the dock (2) to the waters, and towing same into the pond (5); tack-welding together the plurality of blocks (1A, 1B) in the floating state in the pond (5); discharging water in the pond (5) to cause the plurality of blocks (1A, 1B) thus tack-welded together to land onto the bottom (5*a*) of the pond (5); and fully welding together the plurality of blocks (1A, 1B) tack-welded together to construct the large-scale marine structure (1).

1 Claim, 7 Drawing Figures

METHOD FOR CONSTRUCTING LARGE-SCALE MARINE STRUCTURE

FIELD OF THE INVENTION

The present invention relates to a method for efficiently and economically constructing a large-scale marine structure which is installed on the sea for developing, for example, a submarine oil field or a submarine natural gas field.

BACKGROUND OF THE INVENTION

Recently, submarine oil fields and submarine natural gas fields are actively developed, and these development activities reach even the deep sea and the icy waters. As a result, marine structures installed on the sea for such development become huge in scale, and it is now impossible to construct such a large-scale marine structure in an existent dock.

As methods for constructing a large-scale marine structure which cannot be constructed in an existent dock as mentioned above, the following methods are known:

(1) As shown in FIG. 4, a plurality of barges, for example two barges 12 are landed via a plurality of blocks 10 onto the bottom of a dock 2 from which water is discharged, so that the upper surface levels of the barges 12 become flush with the level of the site 11. A large-scale marine structure 1 which cannot be assembled in the dock 2 is constructed by using the site 11 and the two barges 12 which are landed via the blocks 10 onto the bottom of the dock 2 and of which the upper surface levels are flush with the level of the site 11. Then, water is introduced into the dock 2 from the surrounding waters until the water surface level in the dock 2 becomes flush with the level of the waters, to cause the two barges 12 to float in the dock 2 together with the thus constructed large-scale marine structure 1, and then, the large-scale marine structure 1 on the two barges 12 is towed out from the dock 2 to the waters. In FIG. 4, 3 is a portal crane (hereinafter referred to as the "prior art 1").

(2) As shown in FIG. 5, a marine structure 1' is constructed, in a dock 2 from which water is discharged, up to a state in which an upper block 1'' is not as yet mounted thereon. Then, water is introduced into the dock 2 from the surrounding waters until the water surface level in the dock 2 becomes flush with the level of the waters, to cause the marine structure 1' in the state in which the upper block 1'' is not as yet mounted thereon to float in the dock 2, and then, the marine structure 1' is towed out from the dock 2 to the waters. The upper block 1'' is mounted by means of a floating crane on the waters onto the marine structure 1' in the state in which the upper block 1'' is not as yet mounted thereon, and the marine structure 1' and the upper block 1'' are welded together to construct a large-scale marine structure 1 which cannot be assembled in the dock 2 (hereinafter referred to as the "prior art 2").

(3) For example, two blocks 1A and 1B for a large-scale marine structure 1, which blocks have a size corresponding to the construction capacity of a dock not shown, are constructed in the dock from which water is discharged. Then, water is introduced into the dock from the surrounding waters until the water surface level in the dock becomes flush with the level of the waters, to cause the two blocks 1A and 1B thus constructed to float in the dock, and then, the two blocks 1A and 1B are towed out from the dock to the waters. The two floating blocks 1A and 1B thus towed out to the waters are assembled on the waters as shown in FIG. 6, so that respective portions to be welded come into contact with each other. Then, the two floating blocks 1A and 1B are welded together on the waters to construct the large-scale marine structure 1 which cannot be assembled in the dock (hereinafter referred to as the "prior art 3").

(4) For example, two blocks 1A and 1B for a large-scale marine structure 1, which blocks have a size corresponding to the construction capacity of a dock not shown, are constructed in the dock from which water is discharged. Then, water is introduced into the dock from the surrounding waters until the water surface level in the dock become flush with the level of the waters, to cause the two blocks 1A and 1B thus constructed to float in the dock, and then, the two blocks 1A and 1B are towed out from the dock to the waters. The two blocks 1A and 1B thus towed out to the waters are positioned above two barges 12 previously sunk at a prescribed position in the waters. Then, the two barges 12 are caused to float to mount each of the two blocks 1A and 1B on each of the two barges 12, and the two blocks 1A and 1B on the respective barges 12 are assembled on the waters as shown in FIG. 7, so that respective portions to be welded come into contact with each other. Then, the two blocks 1A and 1B are welded together on the two barges 12 floating on the waters to construct the large-scale marine structure 1 which cannot be assembled in the dock (hereinafter referred to as the "prior art 4").

The above-mentioned prior art 1 has the following problems:

(1) When causing the two barges 12 to float in the dock 2, and towing out the large-scale marine structure 1 on the barges 12 from the dock 2 to the waters, an end portion of the large-scale marine structure 1 projects out of the barges 12. The large-scale marine structure 1 on the barges 12 may thus tend to incline and become unstable.

(2) Because of the necessity of retaining a plurality of barges 12 in the dock 2 for a long period of time, running costs of the barges 12 become higher.

The above-mentioned prior art 2 has the following problem:

(1) Operations on the waters of mounting and welding the upper block 1'' by means of the floating crane onto the marine structure 1' in the state not yet mounted with the upper block 1'', are difficult and inefficient.

The above-mentioned prior art 3 has the following problems:

(1) When welding together the two blocks 1A and 1B on the waters, it is difficult to weld the portions of the blocks 1A and 1B under water.

(2) Because the two floating blocks 1A and 1B swing upon welding same on the waters under the effect of waves of the waters, it is difficult to assemble and weld the portions to be welded together at a high accuracy.

The above-mentioned prior art 4 has the following problem:

(1) Because the two barges 12 swing under the effect of waves of the waters upon welding on the waters the two blocks 1A and 1B mounted on the respective barges 12, it is difficult to assemble and weld the portions to be welded together at a high accuracy.

In order to construct a large-scale marine structure without causing problems as mentioned above, it suffices to expand an existent dock to increase the construction capacity thereof, or construct an extra-large dock having a capacity permitting construction of a large-scale marine structure.

However, expansion of a dock is limited to a certain area from considerations of portal cranes and other existent construction facilities. Construction of an extra-large dock fully equipped with portal cranes and other construction facilities requires investment in a huge amount. Furthermore, even expansion of the dock or construction of an extra-large dock does not necessarily ensure a high operating rate and economic merits since no clear prospect is available as to the future demand for large-scale marine structures.

Under such circumstances, there is a strong demand for the development of a method for efficiently and economically constructing with a small amount of equipment investment a large-scale marine structure which cannot be constructed in an existent dock, but such a method has not as yet been proposed.

DISCLOSURE OF THE INVENTION

An object of the present invention is therefore to provide a method for efficiently and economically constructing with a small amount of equipment investment a large-scale marine structure which cannot be constructed in an existent dock.

In accordance with one of the features of the present invention, there is provided a method for constructing a large-scale marine structure, characterized by:

providing, near a dock of which at least one end faces the waters through a gate, a pond having an end thereof facing said waters through another gate, said pond having a bottom surface area sufficient to permit construction of a large-scale marine structure through assembly of a plurality of blocks for said large-scale marine structure, and said pond having a depth sufficient to cause said large-scale marine structure thus constructed to float in said pond when said another gate is closed and water is introduced into said pond from said waters until the water surface level in said pond becomes flush with the level of said waters;

constructing said plurality of blocks for said large-scale marine structure, which plurality of blocks have a size corresponding to the construction capacity of said dock, in said dock from which water is discharged after closing said gate;

introducing water into said dock from said waters until the water surface level in said dock becomes flush with the level of said waters to cause said plurality of blocks to float in said dock, opening said gate of said dock, and towing out said plurality of blocks from said dock to said waters;

introducing water into said pond from said waters until the water surface level in said pond becomes flush with the level of said waters, opening said another gate of said pond, towing said plurality of blocks towed out to said waters into said pond from said waters, and closing said another gate of said pond;

assembling said plurality of blocks towed into said pond so that portions thereof to be welded come into contact with each other, and tack-welding together said plurality of blocks in the floating state;

discharging water in said pond to cause said plurality of blocks thus tack-welded together to land onto the bottom of said pond;

fully welding together said plurality of blocks tack-welded together to construct said large-scale marine structure; and introducing water into said pond from said waters until the water surface level in said pond becomes flush with the level of said waters to cause said large-scale marine structure thus constructed to float in said pond, opening said another gate of said pond, and towing out said large-scale marine structure from said pond to said waters.

DETAILED DESCRIPTION OF PREFERRED EMBODIMENTS

From the above-mentioned point of view, we carried out extensive studies to develop a method for efficiently and economically constructing with a small amount of equipment investment a large-scale marine structure which cannot be constructed in an existent dock.

As a result, we obtained the following findings: it is possible to efficiently and economically construct a large-scale marine structure with a small amount of equipment investment, by providing, near a dock of which at least one end faces the waters through a gate, a pond having an end thereof facing the waters through another gate; constructing in the dock a plurality of blocks for the large-scale marine structure, which plurality of blocks have a size corresponding to the construction capacity of the dock; towing out the plurality of blocks from the dock to the waters and towing same into the pond; assembling the plurality of blocks towed into the pond in the floating state so that portions thereof to be welded come into contact with each other, and tack-welding together the plurality of blocks in the floating state; discharging water in the pond to cause the plurality of blocks thus tack-welded together to land onto the bottom of the pond; and fully welding the plurality of blocks tack-welded together.

The present invention was made on the basis of the above-mentioned findings. The method of the present invention is described below with reference to the drawings.

Figure 1:
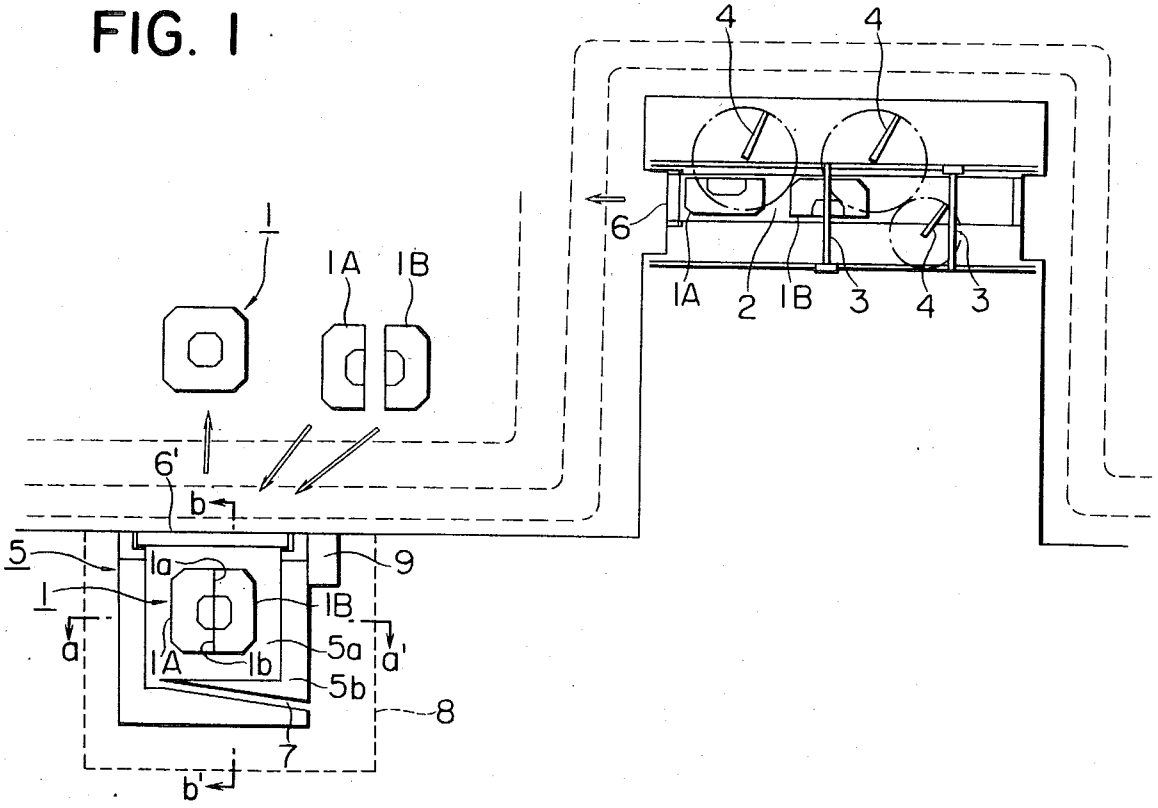
FIG. 1 is a schematic plan view illustrating an embodiment of the present invention.
Figure 2:
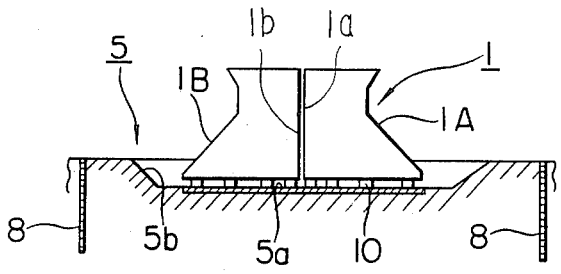
FIG. 2 is an enlarged schematic sectional view of FIG. 1 cut along the line a—a'.
Figure 3:
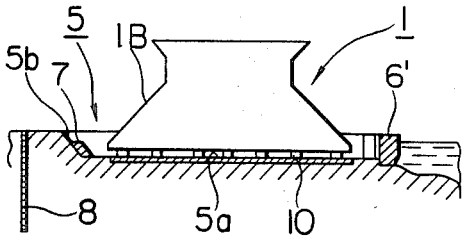
FIG. 3 is an enlarged schematic sectional view of FIG. 1 cut along the line b—b'.
Figure 4:
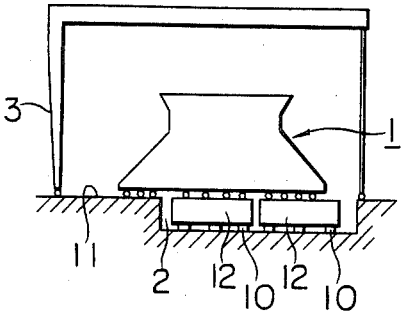
FIG. 4 is a schematic descriptive view illustrating the method of the prior art 1.
Figure 5:
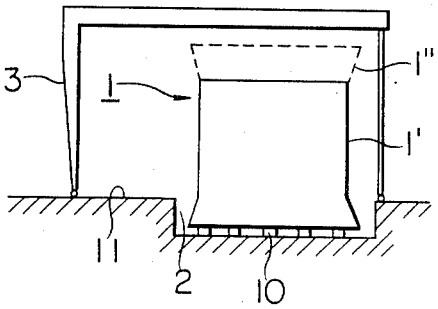
FIG. 5 is a schematic descriptive view illustrating the method of the prior art 2.
Figure 6:
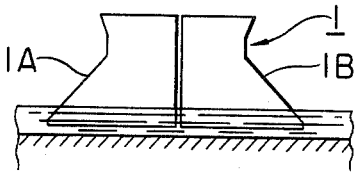
FIG. 6 is a schematic descriptive view illustrating the method of the prior art 3.
Figure 7:
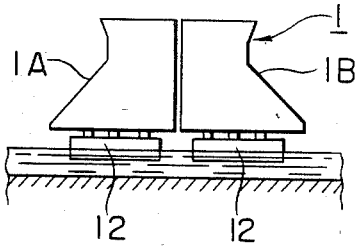
FIG. 7 is a schematic descriptive view illustrating the method of the prior art 4.

FIG. 1 is a schematic plan view illustrating an embodiment of the present invention, FIG. 2 is an enlarged schematic sectional view of FIG. 1 cut along the line a—a', and FIG. 3 is an enlarged schematic sectional view of FIG. 1 cut along the line b—b'. As shown in FIG. 1, a dock 2 of which at least one end faces the waters through a gate 6 is equipped with facilities necessary for the construction of a plurality of blocks for a large-scale marine structure, such as a plurality of portal cranes 3 capable of travelling in the longitudinal direction of the dock 2 and a plurality of pivotable jib cranes 4.

A pond 5 of which an end faces the waters through another gate 6' is provided near the dock 2. The pond 5 has a bottom surface area sufficient to permit assembly of a plurality of, for example, two blocks 1A and 1B to construct a large-scale marine structure 1, and the pond 5 has a depth sufficient to cause the large-scale marine structure 1 thus constructed to float in the pond 5, when another gate 6' is closed and water is introduced into the pond 5 from the waters until the water surface level in the pond 5 becomes flush with the level of the waters.

The bottom 5*a* of the pond 5 is reinforced with concrete so as to be capable of supporting the large-scale marine structure 1 constructed in the pond 5. Side walls 5*b* of the pond 5 are reinforced with gravels or the like to such an extent that the side walls 5*b* do not collapse when water is introduced into the pond 5. Sheet piles 8 are driven into the ground surrounding the pond 5 in order to prevent ground water from penetrating into the pond 5. The sheet piles 8 are driven into the ground spaced apart by a prescribed distance from the pond 5 so as to permit an easy expansion of the pond 5 in the future.

A passage 7 leading from the site to the bottom 5*a* of the pond 5 is provided on one of the side walls 5*b* of the pond 5 for transporting construction machines and materials into the pond 5 from the site. Construction facilities such as portal cranes and jib cranes are not installed on the pond 5, but facilities necessary for assembling and welding a plurality of blocks are provisionally arranged. In FIG. 1, 9 is a pump mechanism for introducing water into the pond 5 from the waters or discharging water in the pond 5 therefrom.

In the dock 2 from which water is discharged after closing the gate 6, for example two blocks 1A and 1B for the large-scale marine structure 1, which blocks having a size corresponding to the construction capacity of the dock 2 are constructed. Then, water is introduced into the dock 2 from the waters by means of a pump mechanism not shown until the water surface level in the dock 2 becomes flush with the level of the waters to cause the two blocks 1A and 1B thus constructed to float in the dock 2, and the gate 6 of the dock 2 is opened to tow out the two blocks 1A and 1B from the dock 2 to the waters.

Water is introduced into the pond 5 from the waters by means of the pump mechanism 9 until the water surface level in the pond 5 becomes flush with the level of the waters, then, another gate 6' of the pond 5 is opened, then, the two blocks 1A and 1B, which are towed out from the dock 2 to the waters, are towed into the pond 5 from the waters, and then, another gate 6' of the pond 5 is closed.

The two blocks 1A and 1B towed into the pond 5 are assembled so that the portion to be welded 1*a* of the block 1A and the portion to be welded 1*b* of the block 1B come into contact with each other, and the two blocks 1A and 1B are tack-welded together in the floating state. Then, water in the pond 5 is discharged by means of the pump mechanism 9 to cause the two blocks 1A and 1B thus tack-welded together to land through a plurality of blocks 10 onto the bottom 5*a* of the pond 5. Then, the two blocks 1A and 1B tack-welded together are fully welded together to construct the large-scale marine structure 1.

Water is introduced into the pond 5 from the waters by means of the pump mechanism 9 until the water surface level in the pond 5 becomes flush with the level of the waters to cause the large-scale marine structure 1 thus constructed to float in the pond 5, and another gate 6' of the pond 5 is opened to tow out the large-scale marine structure 1 from the pond 5 to the waters.

A plurality of blocks for the next large-scale marine structure are constructed in the dock 2 simultaneously with the above-mentioned constructing operations of the large-scale marine structure 1 in the pond 5.

In the above description, the number of blocks for the large-scale marine structure, which are constructed in the dock 2 and assembled in the pond 5 into the large-scale marine structure, is not limited to two, but may be three, four or any other appropriate number corresponding to the construction capacity of the dock 2.

According to the method of the present invention, as described above in detail, a large-scale marine structure is constructed through construction in the dock 2 of a plurality of blocks for the large-scale marine structure, which blocks have a size corresponding to the construction capacity of the dock 2, and welding of the plurality of blocks in the pond 5 provided near the dock 2, and as a result, the following industrially useful effects are provided:

(1) It is possible to efficiently construct a large-scale marine structure.

(2) Since the plurality of blocks for the large-scale marine structure are welded together in a stationary state in which the plurality of blocks land onto the bottom of the pond 5, it is possible to accurately conduct the above-mentioned welding of the blocks.

(3) The pond 5 provided near the dock 2 does not require installation of construction facilities such as portal cranes and jib cranes, and it suffices to simply reinforce the side walls 5*b* of the pond 5 to such an extent that the side walls do not collapse when water is introduced into the pond 5. The amount of equipment investment for the pond 5 is therefore far smaller as compared with that for the dock 2, and it is possible to economically construct the large-scale marine structure.

What is claimed is:

1. A method for constructing a single, large-scale, marine structure, comprising:

providing, near an existent dock of which at least one end faces a body of water through a gate, a pond having an end thereof facing said body of water through another gate, said pond having a bottom surface area sufficient to permit construction of a large-scale marine structure through assembly of a plurality of blocks for said large-scale marine structure, and said pond having a depth sufficient to cause said large-scale marine structure thus constructed to float in said pond when said another gate is closed and water is introduced into said pond from said body of water until the water surface level in said pond becomes flush with the level of said body of water;

constructing said plurality of blocks for said large-scale marine structure, which plurality of blocks have a size corresponding to the construction capacity of said dock, in said dock from which water is discharged after closing said gate;

introducing water into said dock from said body of water until the water surface level in said dock becomes flush with the level of said body of water to cause said plurality of blocks to float in said dock, opening said gate of said dock, and towing out said plurality of blocks from said dock to said body of water;

introducing water into said pond from said body of water until the water surface level in said pond becomes flush with the level of said body of water, opening said another gate of said pond, towing said plurality of blocks towed out to said body of water into said pond from said body of water, and closing said another gate of said pond;

assembling said plurality of blocks towed into said pond so that portions thereof to be welded come into contact with each other, and tack-welding together said plurality of blocks in a floating state;

discharging water in said pond to cause said plurality of blocks thus tack-welded together to rest on the bottom of said pond;

fully welding together said plurality of blocks tack-welded together to construct said large-scale marine structure; and introducing water into said pond from said body of water until the water surface level in said pond becomes flush with the level of said body of water to cause said large-scale marine structure thus constructed to float in said pond, opening said another gate of said pond, and towing out said large-scale marine structure from said pond to said body of water.

* * * * *